US006073817A

United States Patent [19]

Jairazbhoy

[11] Patent Number: 6,073,817

[45] Date of Patent: Jun. 13, 2000

[54] PNEUMATICALLY-ACTUATED THROTTLE VALVE FOR MOLTEN SOLDER DISPENSER

[75] Inventor: Vivek Amir Jairazbhoy, Farmington Hills, Mich.

[73] Assignee: Ford Motor Company, Dearborn, Mich.

[21] Appl. No.: 09/148,532

[22] Filed: Sep. 4, 1998

[51] Int. Cl.[7] ..... B22D 39/02

[52] U.S. Cl. ..... 222/595; 222/591

[58] Field of Search ..... 222/595, 591, 222/590, 594, 420, 213

[56] References Cited

U.S. PATENT DOCUMENTS

| | | | |
|---|---|---|---|
| 4,403,764 | 9/1983 | Repplinger | 251/5 |
| 4,560,100 | 12/1985 | Hall | 228/40 |
| 4,649,898 | 3/1987 | Martinson | 126/369 |
| 4,788,403 | 11/1988 | Hayakawa et al. | 219/85 BA |
| 4,889,033 | 12/1989 | Onishi et al. | 91/6 |
| 5,133,120 | 7/1992 | Kawakami et al. . | |
| 5,145,691 | 9/1992 | Kawakami et al. . | |
| 5,238,176 | 8/1993 | Nishimura . | |
| 5,364,011 | 11/1994 | Baker et al. . | |
| 5,820,772 | 10/1998 | Freitag et al. | 222/595 |

*Primary Examiner*—Scott Kastler
*Attorney, Agent, or Firm*—Leslie C. Hodges

[57] ABSTRACT

A pneumatic actuator for use with a pump for dispensing molten solder on a surface, such as an integrated circuit substrate. The pump has a reservoir for containing molten solder, a nozzle for dispensing molten solder on the substrate, a diaphragm pump with a pump cavity situated in fluid communication with the reservoir and with a flow intake portion of the nozzle, and an adjustable throttle for controlling the flow of molten solder from the reservoir to the diaphragm pump. The throttle defines an annular throttle gap between the reservoir and the pump cavity to vary the effective throttle area. A spring-loaded diaphragm for adjusting the throttle defines in part a pneumatic chamber. A solenoid valve is situated in a compressed gas feed passage extending to the pneumatic chamber. The spring-loaded diaphragm is effective to control the throttle opening with a controlled delay following activation of the solenoid valve so that optimum throttle resistance can be achieved at the beginning of a solder-dispensing pulse, while providing optimum throttle resistance during the remainder of the pulse such that instantaneous cutoff of the flow through the nozzle is achieved without effecting a reverse flow of air through the nozzle into the pump chamber at the end of the solder dispensing pulse.

9 Claims, 7 Drawing Sheets

PNEUMATICALLY-ACTUATED THROTTLE VALVE FOR MOLTEN SOLDER DISPENSER

TECHNICAL FIELD

The invention relates to a pneumatically-actuated throttle valve for a molten solder dispenser.

BACKGROUND OF THE INVENTION

The invention comprises improvements in a molten solder dispenser of the kind disclosed in copending U.S. patent application Ser. No. 08/786,562, filed Jan. 21, 1997, entitled "Valveless Diaphragm Pump For Dispensing Molten Metal". That application is assigned to the assignee of the present invention.

The solder-dispensing pump disclosed in the patent application identified above includes an adjustable throttle that provides a variable flow area for a molten metal flow orifice between a pumping chamber and a reservoir for the molten metal. The pump comprises a diaphragm that is actuated pneumatically. Displacement of the diaphragm changes the effective volume in the pumping chamber, thereby creating flow of molten metal in one direction through metal dispensing nozzles and in the other direction toward the reservoir. The maximum diaphragm displacement is controlled by a stop. Molten solder delivered by the nozzles in this fashion, as molten metal is deposited on a substrate does not require pre-heating nor post-heating of the substrate in the manufacture of integrated circuit boards and the like. It is also possible, using a molten solder pump of the type disclosed in the co-pending application to avoid problems due to the temperature of the molten solder, which may exceed 200° Centigrade. Deterioration of rubber seals and thermal expansion mismatches in the elements of the pump are some of the problems that are avoided.

The control of the molten solder through the solder-dispensing nozzles of a pump of the type disclosed in the co-pending application requires precision control of an adjustable throttle orifice. Such precision control is difficult to achieve because the flow of molten solder through the nozzle orifice is very sensitive to adjustments of the throttle. It is difficult with a single throttle adjustment to control the instant the liquid solder flow is cut off. Unless the flow is precisely controlled at the cutoff instant, dripping of molten solder or dribbling will occur following the cutoff as a result of the downward momentum of the dispensing stream of molten solder. A separate solenoid valve cannot be used to achieve throttle control because the variability in throttle actuation time is larger than the desired time lag between the actuation of the diaphragm and the actuation of the throttle.

The flow of molten solder through the nozzles is interrupted when the diaphragm hits the stop in the pump disclosed in the co-pending application as the upward momentum of the solder in the throttle opposes the downward momentum of the solder in the nozzles. If the upward momentum of the solder in the throttle is less than the downward momentum of the solder in the nozzles, the solder will continue to dribble from the nozzles for a brief period before the interface between the solder and the surrounding gas at the nozzle exits recedes.

It further is difficult with a pump such as that disclosed in the co-pending application to control the upward momentum of the solder so that the solder/gas interface at the nozzle exits will not rise above the entrance of the nozzle. This would generally occur when the throttle opening is too large. The upward momentum of the solder in the throttle then would be much larger than the downward momentum of the solder in the nozzles at the moment that the diaphragm hits the stop. The retraction of the solder/gas interface is further accelerated by surface tension forces. Ambient gases, if they are drawn into the pumping chamber through the nozzle following interruption of the dispensing of the molten solder, could result in pump malfunction since trapped gas would tend to compress and decompress slowly during the dispensing cycle, thereby causing further dribbling or dripping of molten solder at the nozzle exits. Such dribbling or dripping of molten solder from the nozzles following interruption of the liquid nozzle flow would tend to deposit small satellite drops on the substrate surface which could lead to shorts across the leads of the integrated circuit device.

BRIEF DESCRIPTION OF THE INVENTION

The improved liquid solder-dispensing pump comprises a pumping diaphragm which defines in part a pumping chamber that communicates with a liquid solder reservoir and with solder-dispensing nozzles. Displacement of the diaphragm changes the volume of the pumping chamber. Diaphragm displacement is limited by an adjustable stop.

The volume of the solder that is dispensed is a function of the diaphragm displacement, the throttle position, and the geometry of the nozzles. The diaphragm is activated pneumatically by a compressed gas delivery circuit. A solenoid valve controls delivery of compressed gas to both the diaphragm and a pneumatic actuator chamber. The pneumatic actuator includes a spring-loaded diaphragm sleeve that surrounds an adjustable throttle, the latter controlling a throttle opening or orifice that provides communication between the pumping chamber and a reservoir for the molten solder.

When the diaphragm hits the stop, that is a signal that the appropriate quantity of solder has been dispensed through the nozzle. At that instant, there is an instantaneous upward force that counteracts the downward momentum of the molten solder that is being dispensed through the nozzles.

The improvements of the present invention include means for counteracting the momentum of the molten solder being distributed downwardly through the nozzles with an upward momentum of the molten solder that flows from the pumping chamber to the reservoir. If the upward momentum creates a force that is too small relative to the momentum of the downwardly directed dispensing stream, there will be a tendency for the dispensing stream to continue passing through the nozzles for a short period following the instant the diaphragm hits the stop. This causes dribbling or dripping from the nozzle exits. On the other hand, if the momentum of the molten solder passing upwardly through the adjustable throttle opening is too large, the dispensing stream then is quickly moved in an upward direction at a significant velocity. This may cause the interface of the molten solder and the ambient gas at the exit of the nozzles to recede in an upward direction through the nozzles and to draw ambient gases into the pump chamber.

The improved pump of the invention reduces the sensitivity of the adjustable throttle of a molten solder dispensing pump of the type shown in the copending application. This is accomplished in the pump of the present invention by providing an active throttle control, including a throttle sleeve surrounding a manually adjustable throttle shaft, which provides adequate control notwithstanding the very small desired time lag between the actuation of the throttle and actuation of the diaphragm. It provides ideal throttle control both at the beginning of the pressure pulse, when a small resistance to flow solder is desirable in order to build up throttle momentum, and a fairly large resistance at the end of the pulse in order to contain acceleration of the interface of the molten solder with the ambient gases as the interface recedes following cutoff of the dispensing of the solder.

It is an objective of the invention to provide a throttle control in a positive displacement pump, which includes a common pneumatic system for driving both the diaphragm pump and the actuator for the throttle sleeve which varies the effective opening of the throttle.

An accumulator and a flow valve are situated in the pneumatic circuit that contains the solenoid valve, thereby providing an adjustable delay between the triggering of the solenoid valve and the motion of the throttle sleeve which controls the throttle opening. The accumulator may be an adjustable volume accumulator if an additional calibration variable is desired.

The accumulator comprises a chamber which fills during actuation. The capacity of the accumulator is designed so that after an adjustable delay of a few milliseconds, which coincides with the early part of the pressure pulse, the pressure downstream of the accumulator is sufficient to drive the actuator and alter the throttle resistance during the remainder of the pulse. This, in turn, controls the velocity of the molten solder upwardly in the nozzles following contact of the diaphragm of the adjustable diaphragm stop.

In accordance with one aspect of the invention, which is not specifically directed to a molten solder dispenser, a single actuator valve (e.g., a solenoid operated valve) is capable of initiating operation of one or more pneumatic actuators for independently controlling pressure-responsive, fluid flow control valves or other control devices such as fluid flow or pressure controllers in a hydraulic circuit. The solenoid operated valve is located on the upstream side of the pneumatic actuators and the control devices. Parallel, split gas pressure distribution passages extend to the control devices and the pneumatic actuators from the solenoid operated valve so that the pneumatic actuators and the control devices have tailored responses (i.e., independently calibrated response time delays) to actuation of the solenoid operated valve.

PARTICULAR DESCRIPTION OF THE INVENTION

Figure 1:
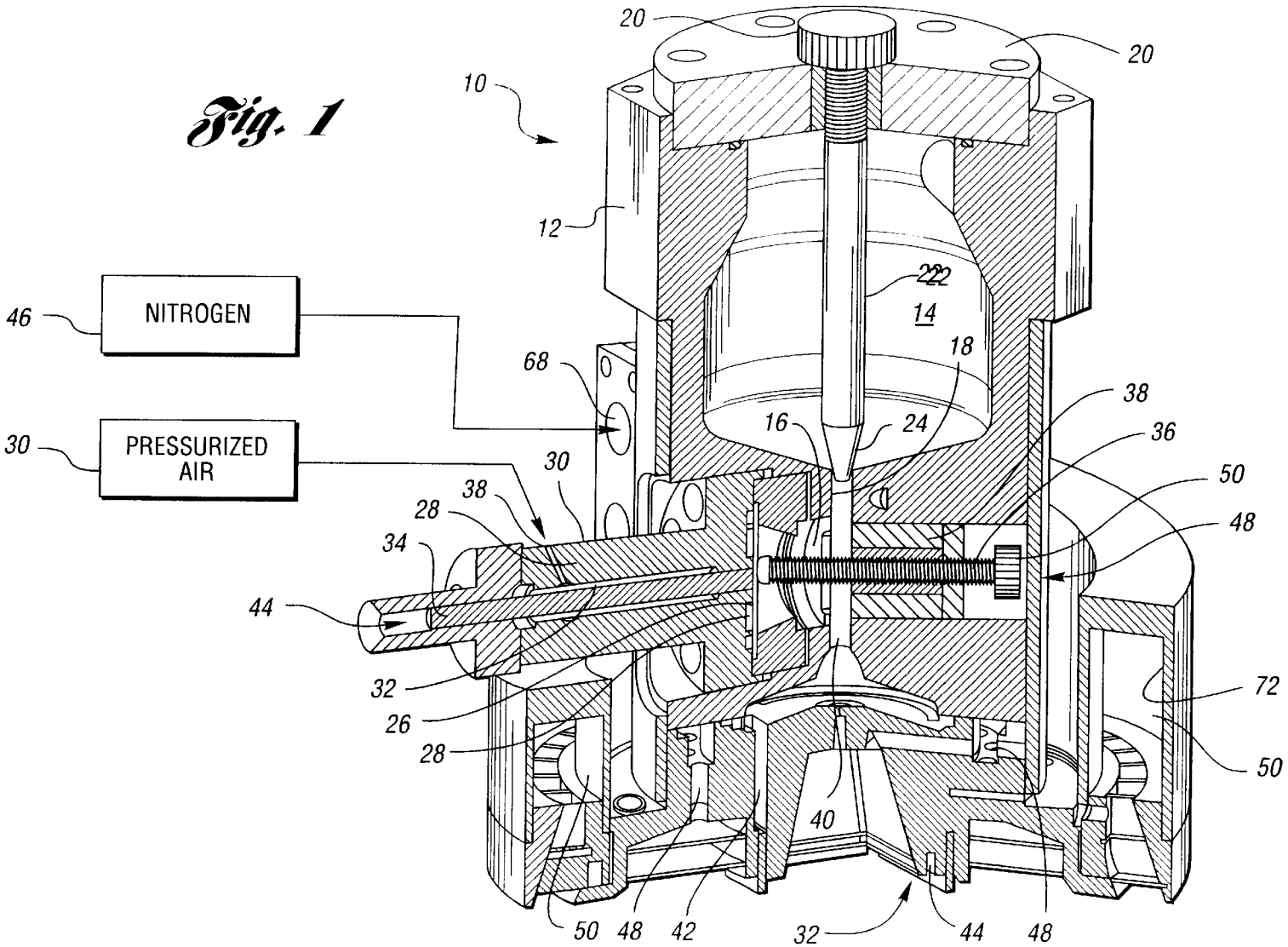
FIG. 1 is a cross-sectional view of a diaphragm pump of the type described in the copending patent application previously identified.

Shown in FIG. 1 is a valveless diaphragm pump for dispensing molten metal. This pump is disclosed in the previously identified copending patent application.

The pump of FIG. 1 is capable of dispensing solder at temperatures in excess of 250°. It includes a valveless molten metal diaphragm pump having an adjustable stop that limits the travel of the diaphragm of the pump. Provision is made also for adjusting the throttling of the flow of liquid solder to the pump cavity. The components of the construction of FIG. 1 comprise principally titanium. Those portions of the pump that are subjected to temperatures in excess of 250° eliminates the need for immersing the substrate for the workpiece in solder or in high temperature ovens, thereby making it possible to use substrates with lower melting temperatures and less robust structural integrity.

The solder reservoir for the pump of FIG. 1 and the pumping chamber are in fluid communication with each other. The pumping chamber also is in fluid communication with discharge nozzles. The diaphragm portion of the pump disclosed in FIG. 1 is secured within the pump body by an internal clamp, which is provided with pressurized air passages that force the diaphragm in a solder-dispensing direction, the displacement of the diaphragm being limited by this adjustable stop. There are no movable valve elements in the fluid channels that provide communication between the reservoir and the pumping chamber and between the solder-dispensing nozzles and the pumping chamber.

The pump assembly of FIG. 1 is shown at 10. It includes a body 12 with an internal solder reservoir 14. Pumping chamber 16 communicates with the reservoir 14 through a channel 18. The top of the reservoir is closed by a closure disc 20.

An adjustable throttle 22 is threaded in the disc 20. It has a tip portion 24 that registers with the channel 18 for selectively throttling the flow of fluid between the reservoir 14 and the pumping chamber 16.

Pumping chamber 16 is defined by a thin movable diaphragm 26, secured in the body 12 by diaphragm clamp 28 which engages the periphery of the diaphragm 26. A source of pressurized air 30 communicates with the left side of the diaphragm clamp 28 through internal passages 32. Displacement of the diaphragm is measured by a displacement sensor, which may include a displacement probe 34.

An adjustable stop 36 is threadedly received in a fitting 38 secured within the body 12. The end of the adjustable stop is adapted to engage the diaphragm 26 when the diaphragm deflects under the pneumatic force created by the pressurized air at source 30. Displacement of the diaphragm will cause molten solder to be dispensed through passage 40 into channels 42, which communicate with nozzle openings 44. Pressure from source 46 is distributed through channels 48 and 50 formed in pump body 12.

At the beginning of the dispensing cycle, pressurized air deflects the diaphragm, thereby displacing molten solder upwardly through the channel 18 and downwardly through the channel 40. This movement of the molten solder continues until the diaphragm hits stop 36. The upward momentum of the molten metal passing through the channel 18 ideally should cancel the downward momentum of the molten through the channel 40. The flow of metal through the channel 40 can be controlled manually by appropriately adjusting the throttle 22.

The instantaneous upward force acting on the molten solder due to the inertia of the molten solder passing through the channel 18 must be controlled accurately so that the downward momentum of the molten solder passing through channel 40 is counteracted. After the diaphragm movement has been halted by the stop, the net momentum of the combined streams should be very nearly zero.

Once the dispensing stream has been halted, there is a tendency for the solder to recede upwardly through the nozzle openings due to surface tension forces. This upward movement of the molten metal in the nozzle openings toward the entrances of the nozzle openings accelerates as the dispensing stream recedes.

If the upward force due to the upward momentum of the molten metal passing through channel 18 is too small, the dispensing stream passing through channel 40 and through the nozzle openings tends to continue downward for a short period before the molten metal begins to recede due to the surface tension effect. This could cause a dribbling or an unwanted disbursing of the molten metal from the nozzle exits. This results in the misdirected dispensing and a coalescing of solder globules. On the other hand, if the upward force acting on the molten solder is too large after the diaphragm hits the stop 36, the dispensing stream passing through the nozzle openings is "wrenched" upward at a relatively high speed, possibly as high as 1.5 meters per second. The interface of the molten solder and the surrounding inert gases that pass through the channels 48 and 50, as previously explained, then could rise above the channel entrances before the upward momentum of the molten solder is attenuated. This can cause ambient gases to be drawn into the pump at the end of the dispensing cycle. This will cause the pump to malfunction during subsequent dispensing cycles since the trapped gas tends to compress and decompress slowly during the dispensing operation, thereby causing the solder to dribble from the nozzle exit in an uncontrolled fashion.

The improvements of the invention eliminate the problems that would be associated with an upward momentum that is too large as well as an upward momentum that is too small following the engagement of the diaphragm with the stop.

Figure 2:
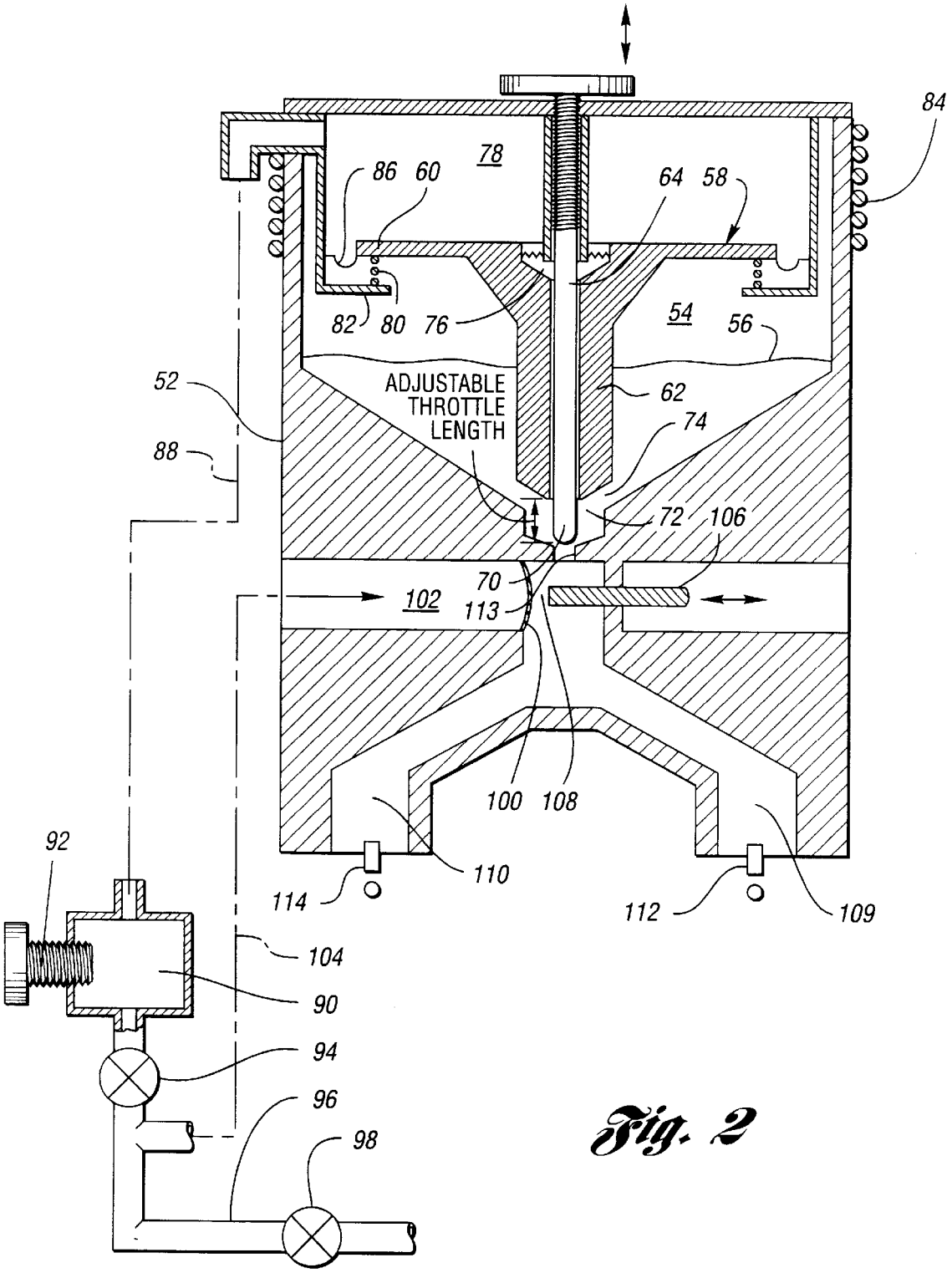
FIG. 2 is a cross-sectional view in schematic form showing the improved pneumatic actuator unit and the pneumatic circuit for the actuator for the improved pump of the invention.

The improved pump of the present invention includes a pneumatic actuator unit which is illustrated in schematic form in the cross-sectional view of FIG. 2. The pump of FIG. 2 includes a pump body 52 which has an internal molten solder reservoir 54. The upper level of the molten solder in the reservoir 54 is shown at 56.

A spring-loaded diaphragm assembly 58 is situated in the housing 52. It includes a diaphragm disc or plate 60 and diaphragm sleeve or stem 62, the latter surrounding an adjustable throttle shaft 64. The upper end of the throttle shaft 64 is threaded at 66 in the upper cover 68 of the pump body 52.

The lower end of the throttle shaft 64 has a tapered or rounded tip portion 70, which registers with a flow control throttle annulus 72 formed in the pump body 52. The throttle shaft 64 is adjustable vertically. The extent of the movement of the throttle shaft in the throttle annulus 72 is designated as the "adjustable throttle length" in FIG. 2.

The sleeve 62 of the diaphragm assembly 58 has a conical lower end that registers with a corresponding conical surface of the body 52 to define an annular flow gap 74. The upper diaphragm plate of the assembly 58 is provided with a flexible seal, such as a bellows type seal 76, which isolates the reservoir from the pressurized chamber 78 located on the upper side of the diaphragm plate 60. The diaphragm plate 60 is biased in an upward direction, as viewed in FIG. 2, by diaphragm spring 80 seated at 82 on a spring seat that is secured to the housing 52.

A heater coil 84 surrounds the housing 52 for the purpose of maintaining a calibrated temperature of the molten solder within the reservoir 54. The margin of the diaphragm plate 60 has a peripheral flexible seal 86.

The chamber 78 communicates through pneumatic passage 88 with an accumulator or tank 90. Provision may be made, if desired, for varying the effective volume of the accumulator 90. A threaded member 92 provided can be advanced and retracted to decrease or increase the volume of the accumulator 90.

The accumulator 90 is in communication with the outlet side of a flow control valve 94 situated in compressed air supply passage 96. A solenoid-operated valve 98 triggers distribution and interruption of the flow of compressed gas through the flow valve into the accumulator. The pressure of the gas in the chamber 78 responds to the opening and closing of the solenoid valve with an appropriate delay determined by the accumulator 90. Although an inert gas supply and inert gas channels are not shown in FIG. 2, they may be used as indicated in the pump construction of FIG. 1.

A flexible diaphragm 100 is located in the pump body 52. A fluid passage 102 communicates with one side of the diaphragm 100 and with the outlet side of the solenoid valve through passage 104. Thus, the solenoid valve controls the distribution of compressed gas pressure to both the diaphragm 100 and the pneumatic chamber 78.

Diaphragm 100 corresponds to diaphragm 26 as shown in FIG. 1 and may be made of the same material.

An adjustable stop 106, corresponding to stop 36 in FIG. 1, is situated in proximity to the right hand side of the diaphragm 100. The diaphragm 100 defines a pump cavity 108 which communicates with the reservoir 54 through the adjustable length flow control throttle annulus 72 and through annular exit gap 74. The cavity 108 communicates also with channels 109 and 110 which supply solder-dispensing nozzles 112 and 114, respectively. Although only two nozzles are shown, a plurality of nozzles can be used.

The throttle annulus 72 communicates with cavity 108 through an orifice 113 of constant size.

The adjustable stop 106 can be threaded in the pump body in a manner similar to the threaded adjustment feature of the adjustable stop 36 of FIG. 1.

The velocity transient of the solder in the channels 108 and 110 can be calibrated using a mathematical simulation of a dispensing cycle. This is accomplished by the annular throttle exit gap established by the sleeve 62, which is relatively insensitive to minor variations in the throttle setting for the throttle stem 64. It establishes a controlled dispense by coupling the response of the throttle to that of the positive displacement diaphragm.

Compared to the design of FIG. 1, the dispense reproducibility and the performance of the design of FIG. 2 are less sensitive to throttle position because the design of FIG. 2 does not rely mostly on changing of throttle aperture, which is typically very small; e.g. between 2–8 millimeters. Small changes in the throttle aperture can make a substantial undesirable difference in the result. The length of the annular gap of the design of FIG. 2, however, can be varied by varying the vertical position of the throttle shaft 64, thereby altering the hydraulic resistance of the annular gap 72. This provides more sensitive throttle control, in contrast to the design of FIG. 1, because the hydraulic resistance of the throttle of FIG. 1 is determined by the top portion 24 of throttle 22. That hydraulic resistance is highly sensitive to small adjustments of throttle 22.

The ideal throttle is one which has a fairly small resistance during the early part of the dispensing cycle to permit build-up of throttle momentum and a fairly large resistance toward the end of the dispensing cycle to contain the acceleration of the interface between the solder and the ambient gases as the interface recedes. A build-up of throttle momentum is achieved with a relatively wide aperture at the exit gap. On the other hand, at the end of the dispensing cycle, the acceleration of the dispensed molten metal is contained as the interface recedes by making the aperture relatively narrow. This strategic control of the effective throttle opening is achieved with the pneumatic actuator unit and the adjustable sleeve which creates the annular exit gap. This is critical for active throttle control since the time scale for a dispensing cycle is far too short (e.g., a few milliseconds) to permit normal feedback control.

Figure 3:
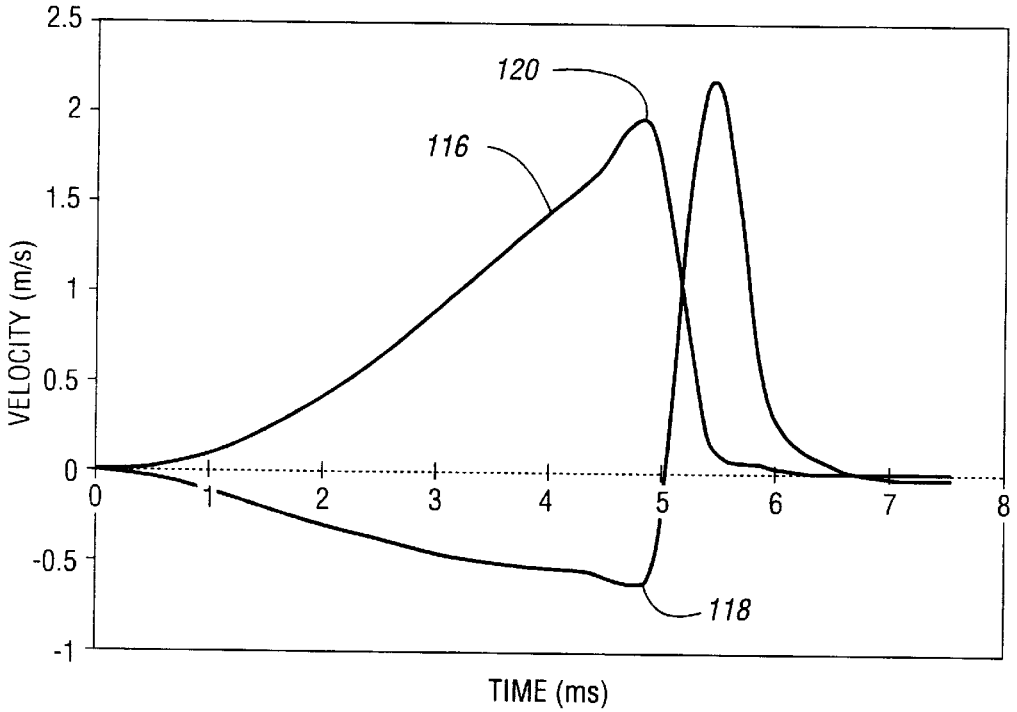
FIG. 3 is a plot of the velocity of the molten solder through the throttle opening and through the nozzle when the throttle opening is smaller than the throttle opening required for optimum performance.

The reason for strategic control of the orifice during separate portions of the dispensing cycle can be seen by referring to the charts of FIGS. 3–13. In FIG. 3, where the throttle opening is almost closed, the velocity of the dispensing molten solder is plotted against time and the downward velocity through the nozzles is shown by curve 116. The velocity of the molten solder that passes from the pumping chamber 108 to the reservoir 54 is shown at 118.

At time 0, the solenoid valve is triggered to begin a dispensing cycle. At a time approximately 4.5 milliseconds later, the diaphragm hits the stop as shown at 120. The downward momentum of the molten solder is greater than the upward momentum of the solder passing through the flow control orifice. Thus, the solder continues to dribble during the time between the 5 millisecond point and the 6 millisecond point. The velocity in the upward direction is very small after the 6 millisecond point because the throttle provides a large hydraulic resistance to the flow receding up the nozzles.

Figure 4:
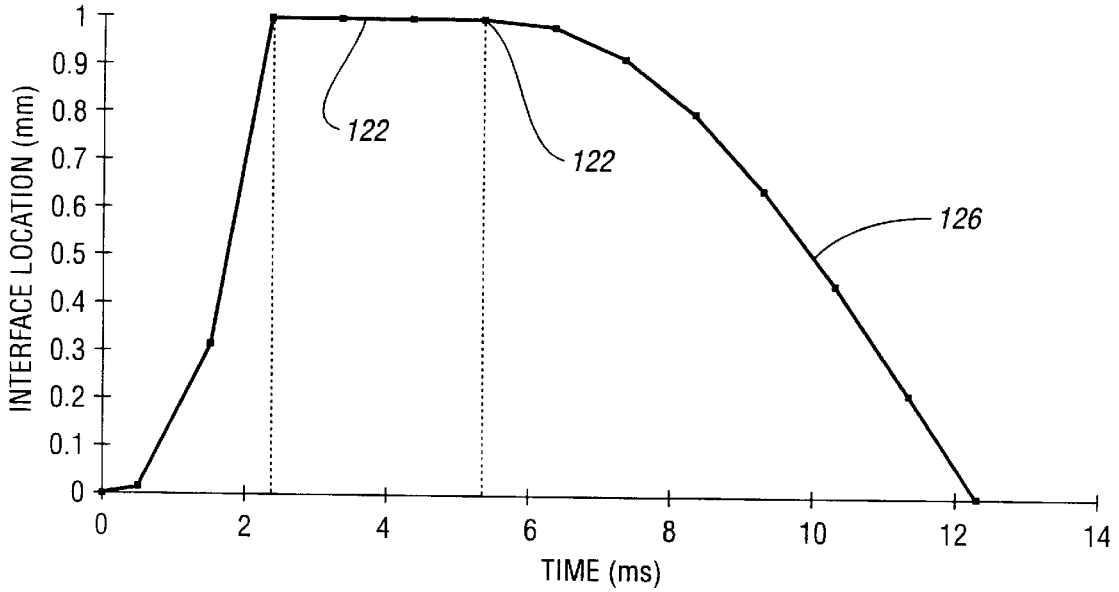
FIG. 4 is a plot showing the position of the interface molten metal and the gases at the exit of the nozzles following contact of the diaphragm with the diaphragm stop.

FIG. 4 shows the interface position for the molten metal being dispensed through the nozzle between time equals zero at the beginning of the dispensing cycle and time equals 2 milliseconds. The interface moves toward the exit of the nozzle between time equals zero milliseconds and time equals 2 milliseconds. The solder/gas interface is at the nozzles exits between 2 milliseconds and 5.5 milliseconds when the molten metal is being dispensed. This is indicated by the flat portion 122 in FIG. 4. After the diaphragm hits the stop at point 124, the interface location moves up as shown at 126 until it reaches the top of the channels that feed the nozzles.

In the case of the plot of FIG. 4, the effective throttle opening is very tight. Before the interface moves up the nozzle channel, the dispensing of excess drops of molten solder is an undesirable result.

Figure 5:
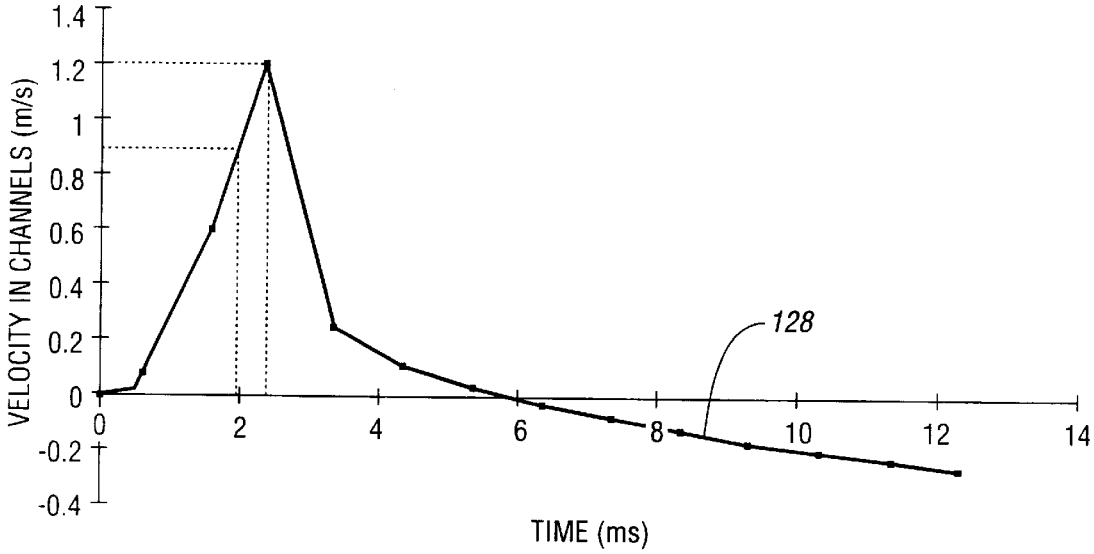
FIG. 5 is a plot of the velocity of molten solder flow in the solder-dispensing nozzles when the throttle is set at a throttle opening less than the optimum setting required to prevent dripping or dribble of solder following engagement of the diaphragm with the diaphragm stop.

FIG. 5 shows the velocity in the channels when the throttle is too tight. In this instance, the velocity in the channels builds up from a 0 value to a value of approximately 1.2 meters per second. After the diaphragm hits the stop following the instant the velocity reaches its peak at about 2.5 milliseconds, the velocity in the channels will decrease rapidly, but the solder will continue to flow downward causing an undesirable dribble between the 3 millisecond point and the 5 millisecond point. A flow reversal occurs as shown at 128 as the interface slowly accelerates upwardly in the nozzle channels due to surface tension.

Figure 6:
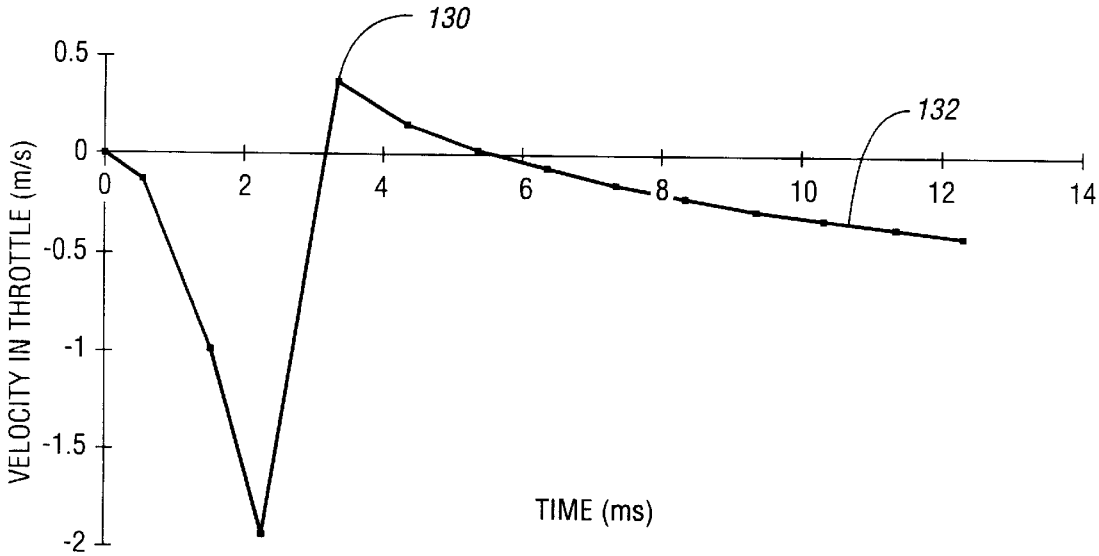
FIG. 6 is a plot showing the velocity of the solder through the throttle opening when the throttle opening is less than the desired optimum setting.

FIG. 6 shows the velocity of the molten solder through the throttle openings. The velocity will increase in an upward direction during the first two milliseconds of the dispensing cycle. The diaphragm then hits the stop and the velocity quickly drops. This plot complements the plot of FIG. 5. The plot of FIG. 6, as in the case of the plot of FIG. 5, shows the performance of the throttle when the throttle setting is too tight.

At point 130 in the plot of FIG. 6, the molten solder velocity reverses in the throttle at approximately 3.25 milliseconds, as shown at 130, and then decreases until the velocity becomes negative as shown at 132. This is due to the surface tension effect at the nozzle.

Figure 7:
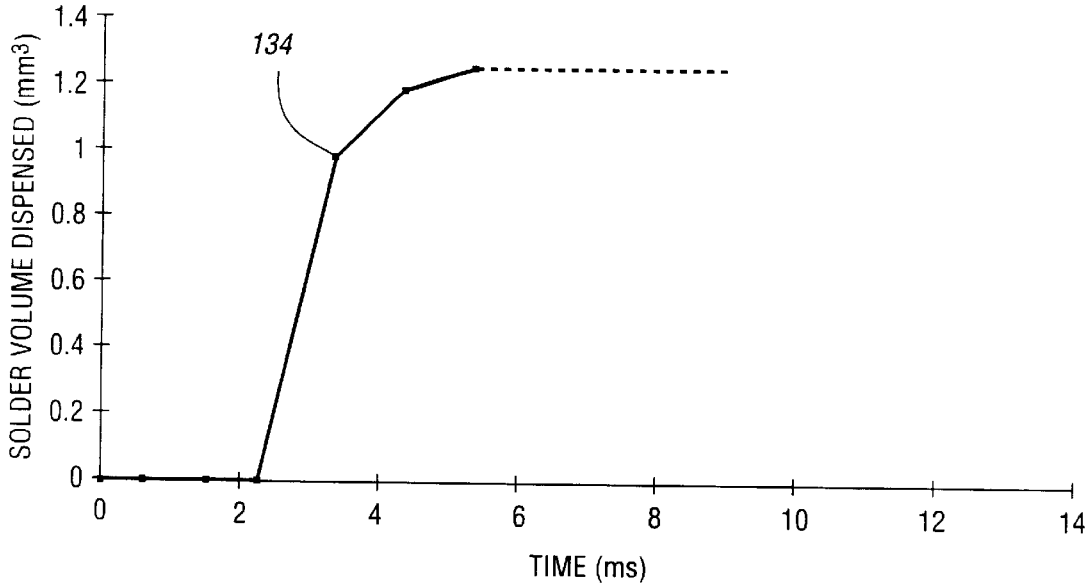
FIG. 7 is a plot showing the volume of solder dispensed during the pulse when the throttle setting is less than the desired setting.

The plot of FIG. 7 shows the solder volume dispensed. In this instance, the volume is about 1.25 cubic millimeters, which corresponds to several drops rather than a single drop. This is the effect of a throttle setting that is too tight.

In the case of FIG. 7, the molten solder is traveling through the channels of the nozzles between 0 milliseconds and 2.25 milliseconds. The diaphragm hits the stop at approximately the 3 millisecond point as shown at 134. Molten solder, however, continues to be dispensed until approximately the 6 millisecond point because of the tight throttle setting.

Figure 8:
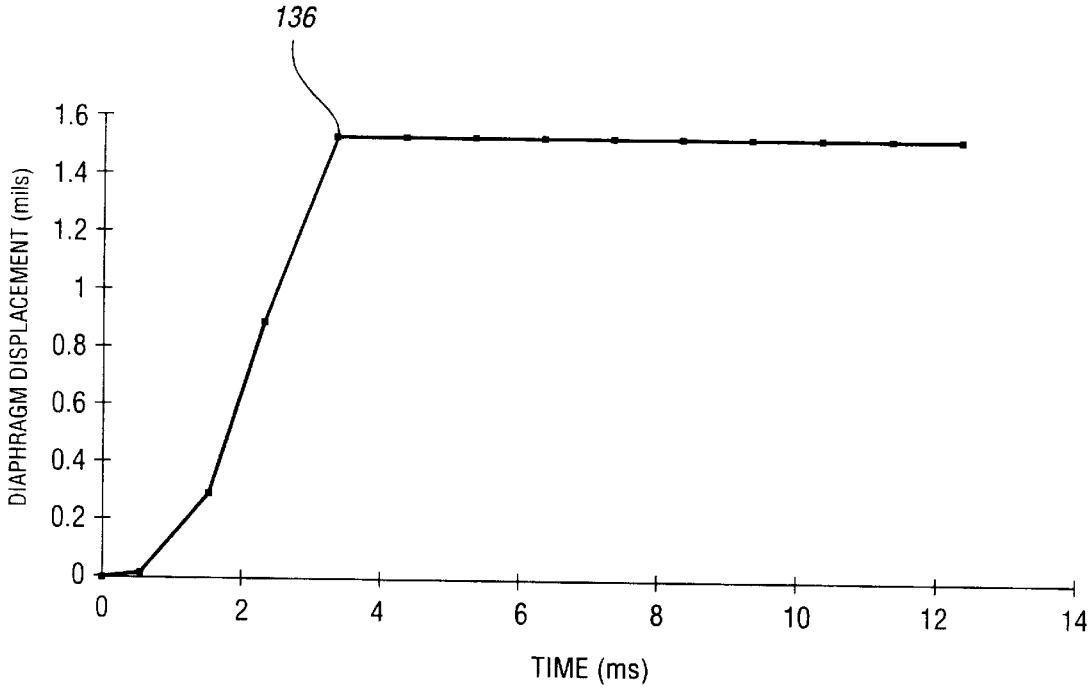
FIG. 8 is a plot showing the displacement of the diaphragm during the pressure pulse.

The plot of FIG. 8 shows the diaphragm displacement versus time between time 0 milliseconds and 3 milliseconds. The diaphragm hits the stop at approximately the 3 millisecond point as shown at 136. The position of the diaphragm then remains constant as shown at 138.

Figure 9:
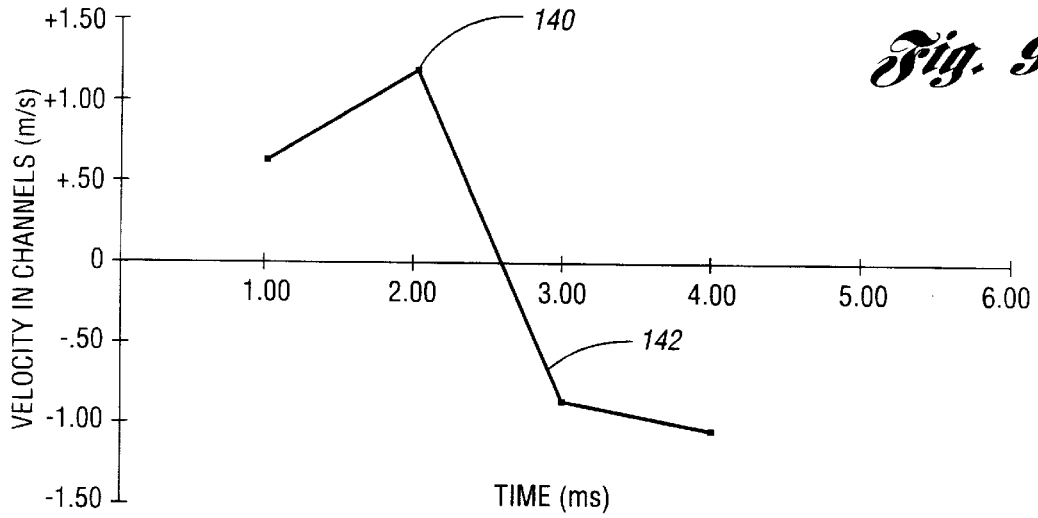
FIG. 9 is a plot showing the velocity of the liquid solder in the nozzles during a pressure pulse when the area of the throttle is greater than the optimum setting.

The plot of FIG. 9 shows the velocity in the channels during the dispensing cycle when the throttle area has been adjusted to a high area setting (e.g., a setting that is higher than the optimum setting). In this instance, the diaphragm deflects beginning at the start of the cycle until the 2 millisecond point is reached. At that time, the diaphragm hits the stop as shown at 140. The velocity in the nozzle channels then decreases and becomes negative as shown at 142. The negative velocity is relatively high. This high area adjustment of throttle is undesirable because it can result in an upward momentum that is greater than the counteracting momentum of the downwardly moving molten solder through the nozzles. This can draw gas into the pumping chamber as previously explained because of the rapid retraction of the interface of the solder and the ambient gases. At the top of the channels, the velocity is greater than 1 millisecond. Thus, there is a greater propensity to draw gas into the pump.

Figure 10:
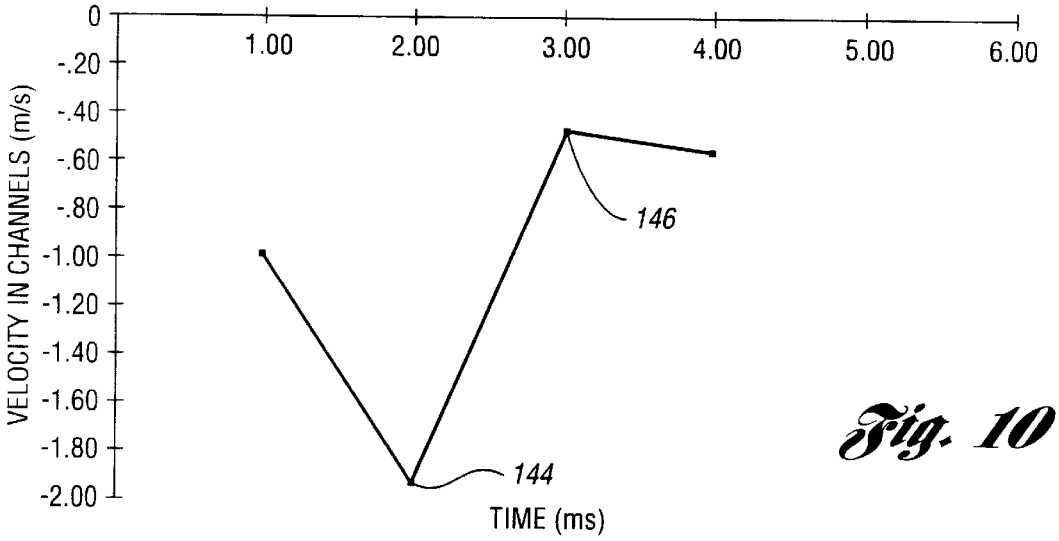
FIG. 10 is a plot showing the velocity of the solder in an upward direction through the throttle opening during the pulse cycle when the area of the throttle opening is greater than the optimum setting.

The plot of FIG. 10 is a complement of the plot of FIG. 9. FIG. 10 shows the molten solder velocity in the throttle versus time. When the area of the throttle is adjusted to a setting that is too high, the diaphragm hits the stop at approximately the 2 millisecond point, as shown at 144, thereby causing a reduction in upward flow velocity in the throttle opening. After the 3 millisecond point is reached at 146, the flow in the throttle accelerates due to the surface tension forces in the molten solder in the nozzles.

Figure 11:
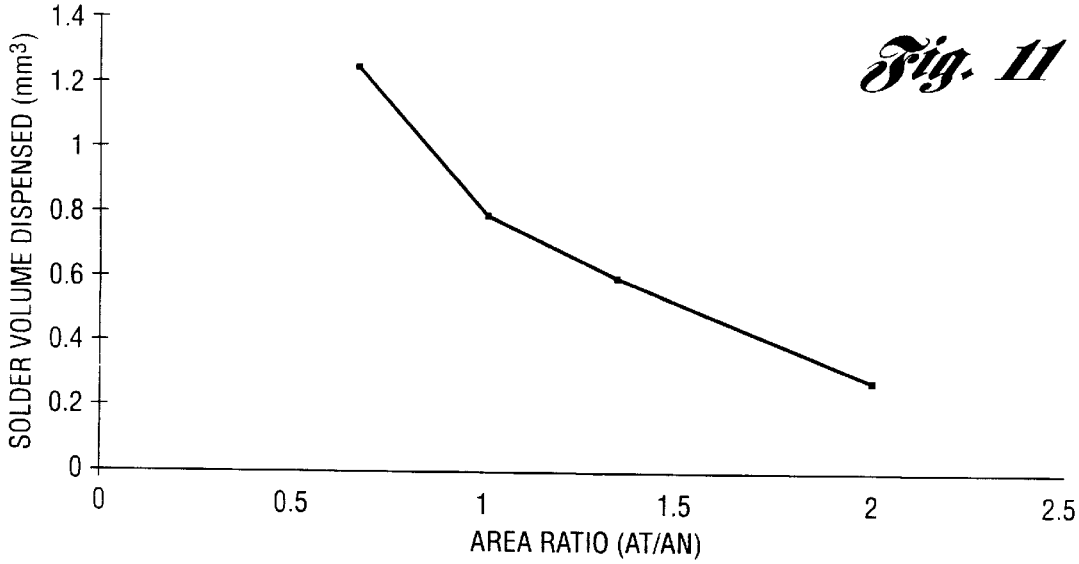
FIG. 11 is a plot showing the solder volume dispensed for various ratios of the areas of the throttle and the nozzle.
Figure 12:
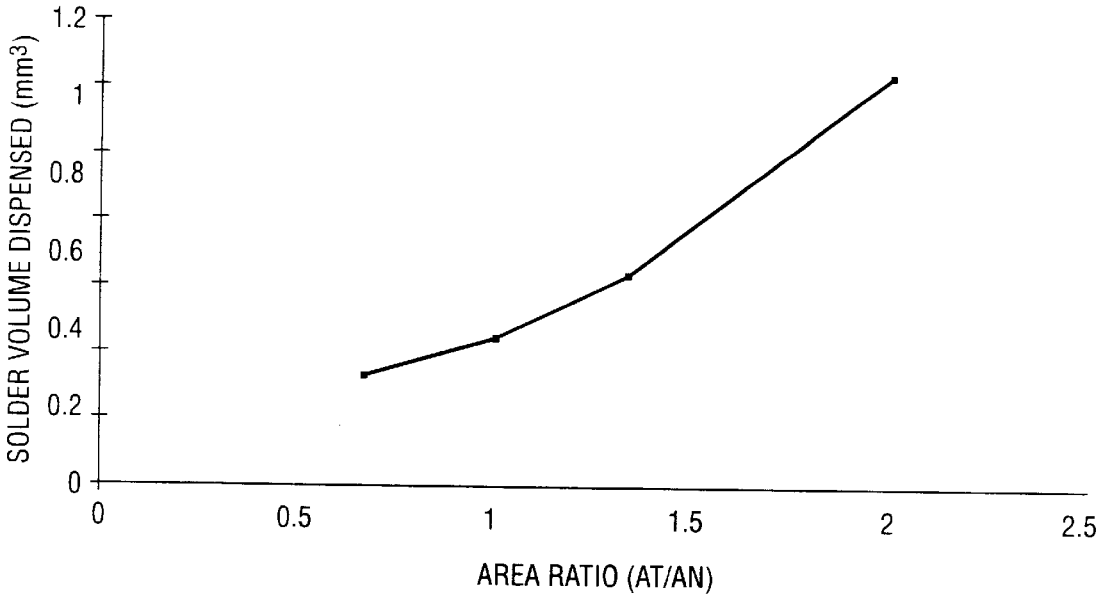
FIG. 12 is a plot showing the peak retraction velocity of the molten metal in the nozzles after the diaphragm hits the diaphragm stop for various ratios of the areas of the throttle opening and the nozzle.

The plot of FIG. 11 shows the effective area ratio on solder volume dispensed. FIG. 12 shows the peak solder retraction velocity versus area ratio.

The system parameters should be chosen such that a desired amount of solder is first dispensed and then followed soon thereafter by the diaphragm hitting the stop. The throttle should be tuned such that the momentum of the moving molten solder at that instant at the throttle and the momentum of the moving molten solder at the nozzle roughly cancel each other. The solder then will proceed up the channels with a low velocity, thereby reducing the propensity to draw gas into the pump.

Figure 13:
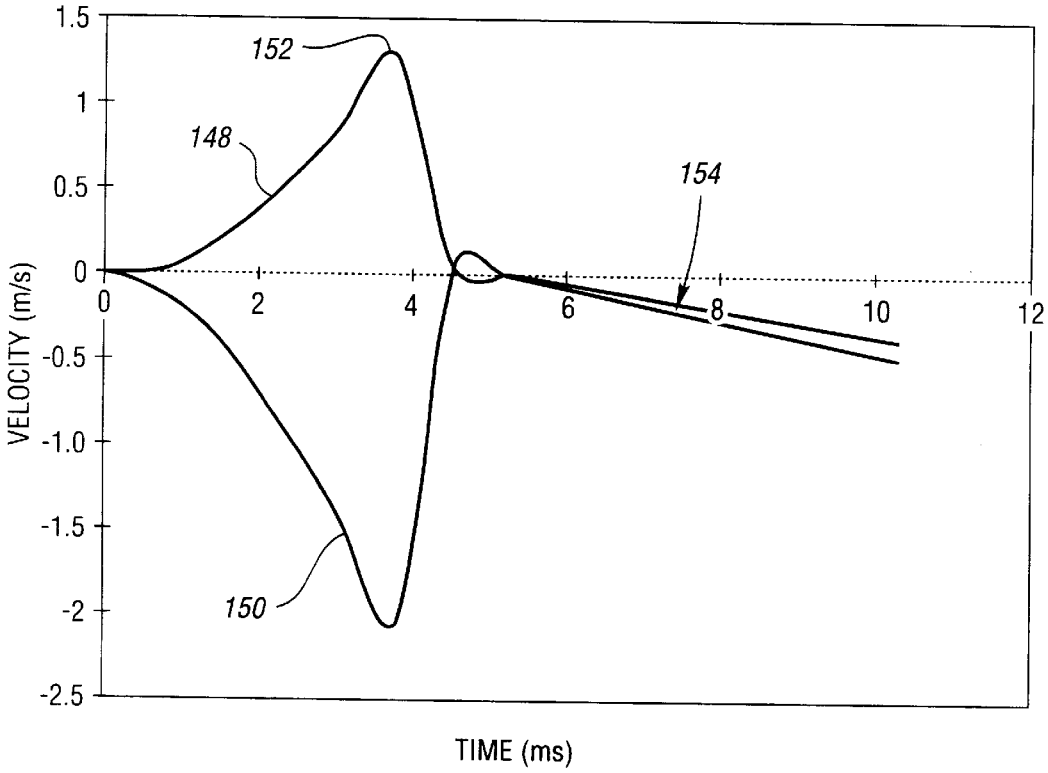
FIG. 13 shows the throttle and nozzle velocities for ideal throttle settings whereby the upward momentum of the solder through the throttle opening balances the downward momentum of the molten solder through the nozzle at the termination of the molten metal dispensing cycle.

FIG. 13 shows the performance corresponding to a setting for the throttle that approaches an ideal setting. This is a moderate setting intermediate the settings described in FIGS. 4–12. In the case of the plot of FIG. 13, the velocity of the molten solder in the nozzles, shown at 148, is sufficient to create a momentum that generally counterbalances the momentum of the upwardly moving molten solder through the throttle opening. The velocity of the flow through the throttle opening is shown in FIG. 13 at 150.

When the diaphragm hits the stop at approximately 3.75 milliseconds, as shown at 152, the upwardly moving molten solder velocity, as well as the downwardly moving molten solder velocity, rapidly decrease to approximately 0 at 4.5 milliseconds. Thereafter, the flow through the throttle and the flow through the nozzle retract gradually, as shown at 154 in FIG. 13. Even then, an upward velocity of about 0.5 milliseconds is reached at time t=10.25 milliseconds, which still could be high enough to draw gas into the pump in some instances.

It is clear from the foregoing description that it is desirable to have an "optimum"(i.e., not too large, not too small) throttle setting during displacement of the diaphragm, and a "tight" throttle setting after the diaphragm hits the stop to provide hydraulic resistance and thus reduce acceleration of the solder as it recedes up the nozzle. This demonstrates the need for an active throttle that activates a few milliseconds after the diaphragm begins its displacement.

Although a preferred embodiment of the invention has been disclosed, modifications to the invention might be made by persons skilled in the art without departing from the scope of the invention. Such modifications and equivalents thereof are covered by the following claims.

What is claimed is:

1. A pump for dispensing molten solder on a planar substrate comprising a pump body defining a molten solder reservoir;

a pumping chamber in said pump body, said pumping chamber being defined in part by a flexible diaphragm;

a throttle orifice providing communication between said reservoir and said pumping chamber;

at least one molten solder dispensing nozzle, a channel in said pump body connecting said pumping chamber and said nozzle;

a movable throttle adjacent said throttle orifice and defining a throttle gap through which molten solder passes between said reservoir and said pumping chamber;

a gas pressure passage communicating with one side of said diaphragm whereby said diaphragm is deflected into said pumping chamber;

a stop adjacent said diaphragm which engages said diaphragm when said diaphragm deflects a predetermined amount;

a pneumatic actuator means communicating with said gas pressure passage for adjusting said movable throttle to vary the flow area of said throttle gap; and valve means in said gas pressure passage for controlling distribution of gas pressure to said pneumatic actuator and to said one side of said diaphragm during a molten solder dispensing cycle;

said throttle being calibrated to provide an annular throttle gap of variable size during said dispensing cycle whereby the momentum of molten solder moving through said throttle gap substantially counteracts the momentum of molten solder moving through said nozzle at the instant said diaphragm engages said stop.

2. A pump for dispensing molten solder on a planar substrate comprising a pump body defining a molten solder reservoir;

a pumping chamber in said pump body, said pumping chamber being defined in part by a flexible diaphragm;

a throttle orifice providing communication between said reservoir and said pumping chamber;

at least one molten solder dispensing nozzle, a nozzle channel in said pump body connecting said pumping chamber and said nozzle;

a movable throttle adjacent said throttle orifice and defining a throttle gap through which molten solder passes between said reservoir and said pumping chamber;

molten solder in said nozzle channel and ambient gases surrounding said pump defining an interface that moves away from said nozzle under surface tension when flow of molten metal through said nozzle is interrupted;

a gas pressure passage communicating with one side of said diaphragm whereby said diaphragm is deflected into said pumping chamber;

a stop adjacent said diaphragm which engages said diaphragm when said diaphragm deflects a predetermined amount, thereby initiating interruption of molten solder flow through said throttle gap and through said nozzle channel;

a pneumatic actuator means communicating with said gas pressure passage for adjusting said movable throttle to vary the flow area of said throttle gap; and valve means in said gas pressure passage for controlling distribution of gas pressure to said pneumatic actuator and to said one side of said diaphragm during a molten solder dispensing cycle;

said throttle being calibrated to provide an annular throttle gap of variable size during said dispensing cycle whereby the momentum of molten solder moving through said throttle gap substantially counteracts the momentum of molten solder moving through said nozzle at the instant said diaphragm engages said stop and whereby the velocity of molten solder flow through said nozzle channel is modulated following engagement of said diaphragm with said stop.

3. The pump set forth in claim 1 including a manually adjustable throttle shaft within said movable throttle having a valve tip extending within said throttle gap and defining an annulus whereby adjustments of said throttle shaft relative to said movable throttle changes the length of said annulus for said throttle gap to effect variation in resistance to molten solder flow through said throttle gap.

4. The pump set forth in claim 2 including a manually adjustable throttle shaft within said movable throttle having a valve tip extending within said throttle gap and defining an annulus whereby adjustments of said throttle shaft relative to said movable throttle changes the length of said annulus for said throttle gap to effect variation in resistance to molten solder flow through said throttle gap, the molten solder flow area of said throttle orifice being constant.

5. The pump set forth in claim 2 wherein said gas pressure passage includes a gas pressure accumulator between said pneumatic actuator means and said valve means for modifying the rate of pressure build-up in said pneumatic actuator means to provide optimum molten metal flow rates through said nozzle channel following engagement of said diaphragm and said stop whereby ambient gases are prevented from entering said pumping chamber as said interface moves toward said pumping chamber from said nozzle.

6. The pump set forth in claim 5 wherein said gas pressure accumulator is a variable volume accumulator including manual calibration adjustment means for changing the effective volume of said accumulator, thereby tailoring the response time of said pneumatic actuator means to actuation of said valve means.

7. The pump set forth in claim 2 wherein said pneumatic actuator means comprises a disc portion forming a part of said movable throttle, a pneumatic chamber defined in part by said disc portion, said pneumatic chamber being in communication with said valve means whereby said pneumatic chamber and said diaphragm are pressurized simultaneously during each of said dispensing cycles.

8. The pump set forth in claim 7 wherein said gas pressure passage includes a gas pressure accumulator between said pneumatic actuator means and said valve means for modifying the rate of pressure build-up in said pneumatic actuator means to provide optimum molten metal flow rates through said nozzle channel following engagement of said diaphragm and said stop whereby ambient gases are prevented from entering said pumping chamber as said interface moves toward said pumping chamber from said nozzle.

9. The pump set forth in claim 7 wherein said gas pressure accumulator is a variable volume accumulator including manual calibration adjustment means for changing the effective volume of said accumulator, thereby tailoring the response time of said pneumatic actuator means to actuation of said valve means.

* * * * *